US005285713A

United States Patent [19]

Brage

[11] Patent Number: 5,285,713

[45] Date of Patent: Feb. 15, 1994

[54] COUNTERMASS FOR RECOILLESS WEAPONS

[75] Inventor: Anders N. Brage, Sollentuna, Sweden

[73] Assignee: Forsvarets Forskningsanstalt, Sundbyberg, Sweden

[21] Appl. No.: 916,088

[22] PCT Filed: Jan. 29, 1991

[86] PCT No.: PCT/SE91/00064

§ 371 Date: Jul. 29, 1992

§ 102(e) Date: Jul. 29, 1992

[87] PCT Pub. No.: WO91/11672

PCT Pub. Date: Aug. 8, 1991

[30] Foreign Application Priority Data

Jan. 29, 1990 [SE] Sweden ..... 9000302

[51] Int. Cl.[5] ..... E41A 1/10

[52] U.S. Cl. ..... 89/1.704; 89/1.701

[58] Field of Search ..... 89/1.701, 1.702, 1.704, 89/1.706, 1.7

[56] References Cited

U.S. PATENT DOCUMENTS

| | | | |
|---|---|---|---|
| 4,050,351 | 9/1977 | Stauff | 89/1.701 |
| 4,172,420 | 10/1979 | Voss et al. | 89/1.701 |
| 4,244,293 | 1/1981 | Grosswendt et al. | 89/1.701 |
| 4,574,680 | 3/1986 | Nicodemus | 89/1.701 |
| 4,643,071 | 3/1987 | Baechler et al. | 89/1.701 |

FOREIGN PATENT DOCUMENTS

| | | |
|---|---|---|
| 1453826 | 7/1969 | Fed. Rep. of Germany . |
| 408091 | 6/1974 | Sweden . |
| 233347 | 3/1926 | United Kingdom . |

*Primary Examiner*—David H. Brown

*Attorney, Agent, or Firm*—Jacobson, Price, Holman & Stern

[57] ABSTRACT

A countermass for recoilless weapons which is intended to be placed behind the projectile propelling charge (3) of the weapon and which is also intended to depart together with the propellant gases exiting rearwardly from the weapon when the projectile is propelled forwards. The countermass includes a countermass body (5) which is deformable at the pressure and the temperature prevailing in the barrel during firing of the projectile and which has at least one gas through flow passage (6) which widens rearwardly in nozzle form.

5 Claims, 2 Drawing Sheets

COUNTERMASS FOR RECOILLESS WEAPONS

The invention relates to a countermass for so-called recoilless weapons of the kind which include a barrel which is open at both ends and which, when fired, produce a rearwardly directed impulse or thrust which counteracts the recoil forces engendered by the fired projectile. The countermass is positioned behind the propulsive charge and exits together with the rearwardly exiting propellant gases as the projectile is propelled forwards.

In order to obtain a recoilless weapon, an additional propellant charge has been placed behind the projectile and the gas generated thereby is caused to be blown-out rearwardly through an outflow nozzle. This results in a rearwardly directed momentum which can be adapted so as to be equal to the forwardly directed momentum of the projectile. Such a so-called "backblast weapon" produces behind the weapon a pressure of such high magnitude that its effect on the operating personnel places limits on the capacity of the weapon concerned, i.e. on the weight and the muzzle velocity of the projectile used.

It is known to position a countermass behind the propulsive charge, in order to increase the rearwardly directed momentum and therewith increase the capacity of the weapon, without generating excessively high pressure behind the weapon. The countermass is intended to move rapidly rearwards in the barrel, and is normally constructed so that it is vapourized or pulverized behind the weapon. The countermass is normally accelerated as a rigid body in the barrel and then pulverized subsequent to its exit from the barrel.

One drawback with known countermass weapons, however, is that they are either too heavy or generate an excessive high risk zone behind the weapon. Compared with existing rocket-type backblast weapons, the gains have been small both with regard to the effectiveness of the weapon and with regard to the negative effect that the pressure has on the operating personnel.

It is possible to extend the acceleration path of the projectile, so as to increase the muzzle velocity of a given projectile without increasing the size of the propellant charge at the same time. However, this requires a similar extension of the countermass acceleration, or requires the weight of said countermass to be considerably increased. Each increase in the length of the weapon or its weight has a limiting effect on the ease with which the weapon can be handled, and earlier attempts to improve-the capacity of recoilless weapons have often resulted in excessively bulky weapons. Weapons whose capacity has been improved by increasing the maximum pressure in the barrel have also resulted in a heavier weapon, since this improvement requires heavy dimensioning of the barrel.

One object of the present invention is to provide a countermass which will enable the capacity of the weapon to be improved while avoiding the aforesaid drawbacks.

This object and other objects of the invention and advantages afforded thereby, as made apparent in the following description, are achieved with a countermass having the features set forth in the following claims.

According to the invention, the countermass includes a countermass body which will deform at the pressure and temperature that prevails in the barrel during propelling of the projectile, and has at least one throughflow passage through which propellant gases pass and which widens rearwardly in nozzle form.

The throughflow passage is preferably an axially extending passage located centrally in the body.

The pressure which accelerates the countermass body is built-up in front of the narrowest section of the throughflow passage. Because the throughflow passage has the form of a rearwardly widening nozzle, the accelerating force will attack or engage the leading edge of the countermass body (the part facing towards the combustion chamber). This ensures that the total mass of the body will be accelerated in an anticipatable manner and that pressure control resulting from deformation of the body is achieved, as described herebelow. If the throughflow passage is given another shape, for instance the shape of a cylindrical bore, minor variations in the shape of the passage, the passage surface, etc., can cause the acceleration force to engage other parts of the body and cause the body to rupture. The behaviour of the countermass can thus be calculated and the pressure-time sequence can be controlled with a high degree of precision when the throughflow passage has the form of a rearwardly widening nozzle.

The body is composed of a material having a plastic behaviour, or a viscous, viscoplastic behaviour, or preferably the ideal-plastic behaviour of a free-flowing powder at the pressure and temperature concerned.

Part of the rearwardly directed impulse can be obtained by continuously dispersing countermass material and accelerating the dispersed material to a very high velocity in the propellant gases which exit through the throughflow passage during a firing sequence. The throughflow passage will therefore tend to widen, which is counteracted by deformation of the countermass body at the pressure and temperature prevailing in the barrel during firing of the projectile. The countermass body is therefore compressed by the forces of inertia during its acceleration in the barrel and the material of said body is redistributed towards the throughflow passage. This also enables throttling of the gas throughflow to be increased when the countermass body is powerfully accelerated.

A reduced maximum pressure in the combustion chamber and, at the same time, a longer duration of a relatively high pressure in the barrel are obtained when using the inventive countermass. This enables the capacity of the weapon to be increased in comparison with earlier known recoilless weapons, without increasing the weight of the weapon. Alternatively, the weight of the weapon can be reduce, while retaining the capacity of the weapon. Furthermore, the gas outflow from the rear end of the weapon is extended in time with the novel countermass, thereby reducing the effect of pressure on the surroundings and on the operating personnel.

The invention will now be described in more detail with reference to the accompanying drawings.

Figure 4A:
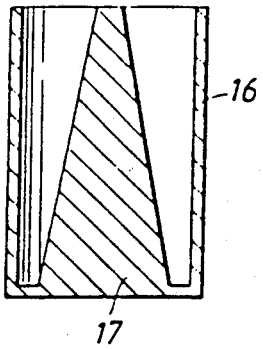
Figure 4B:
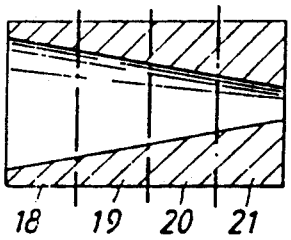
Figure 4C:
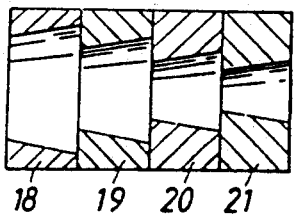

FIGS. 4*a*-*c* illustrate a method for producing a countermass in accordance with the invention.

Figure 5A:
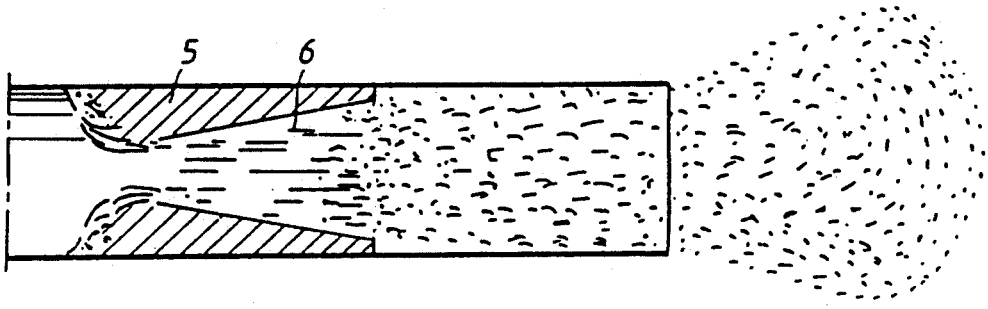
Figure 5B:
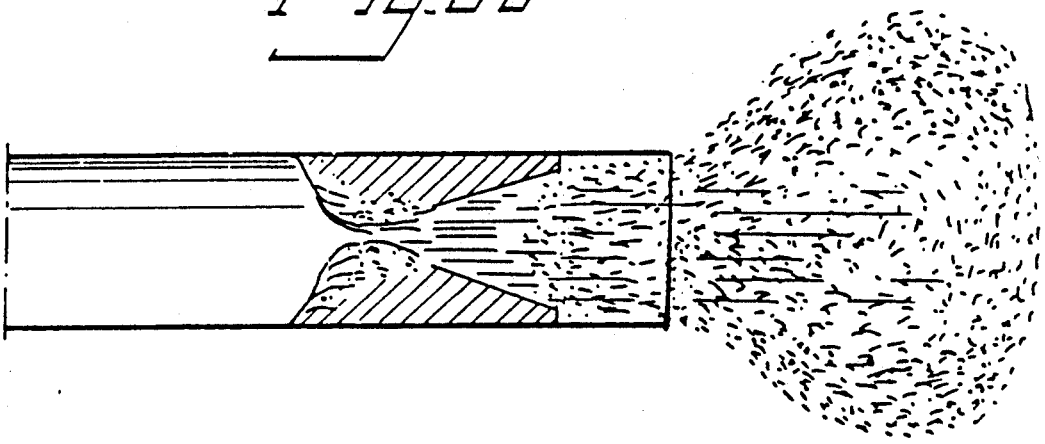
Figure 5C:
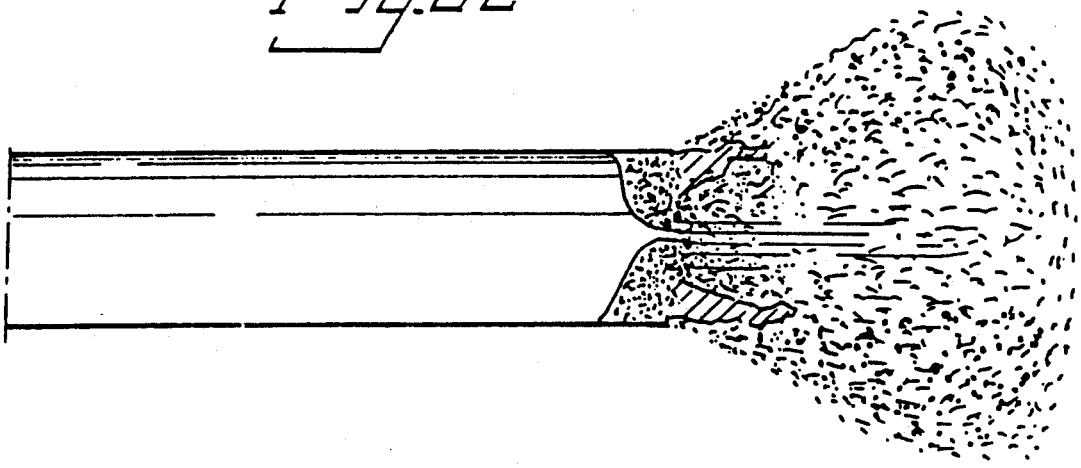

FIGS. 5*a*-*c* illustrate the manner of operation of the countermass at different points of time during a projectile firing sequence.

Figure 1:
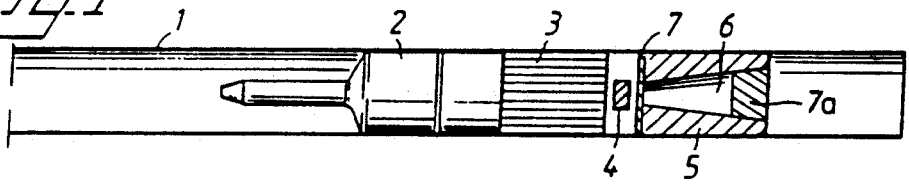
FIG. 1 is a longitudinal section view of one embodiment of an inventive countermass positioned in a schematically illustrated barrel of a recoilless weapon.

In FIG. 1, numeral 1 identifies the barrel of a recoilless weapon. Other weapon components, such as firing mechanism, handle, sights, etc. have been omitted. The reference numeral 2 identifies the weapon projectile, 3 identifies a propellant charge, 4 identifies an igniting charge and 5 identifies an inventive countermass.

In the illustrated embodiment, the countermass comprises a countermass body 5 having a centrally located and axially extending throughflow passage 6, which widens rearwardly in nozzle form.

Located in front of the countermass is a sealing plate 7. A corresponding sealing plate may also be provided behind the countermass. Alternatively, the passage 6 may be blocked initially by a mass 7*a* or the like which is blown from the passageway subsequent to having been subjected to pressure over a given period of time or when a predetermined pressure prevails in the barrel during the initial stage of a firing sequence.

Figure 2:
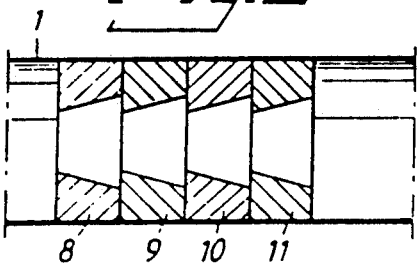
FIGS. 2-3 are sectional views of alternative embodiments of the inventive countermass.

FIG. 2 is a sectional view of a countermass which consists of a plurality of mutually sequential and mutually separate countermass bodies 8–11, each of which has a centrally located, nozzle-forming throughflow passage.

Figure 3:
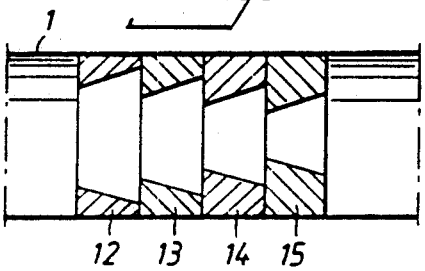

FIG. 3 illustrates a similar embodiment of a countermass comprising a plurality of countermass bodies 12–15. This embodiment differs from the preceding embodiment shown in FIG. 2, in that the inlet areas of the throughflow passage have different sizes for different countermass bodies and become narrower the further rearwardly the body is located in the countermass.

The countermass bodies are constructed from a material which will deform as the body accelerates in the barrel during firing of the projectile. This material will then be redistributed towards the throughflow passage, for instance by plastic flow when the material concerned is given plastic properties or as a result of propagation collapse due to shear forces acting thereon, when the material is given the free-flowing properties of a weakly bonded powder mass. The countermass body can be caused to reduce the cross-sectional area of the throughflow passage in this way when the body is powerfully accelerated.

With regard to the risk zone created behind the weapon, it is appropriate to compose the countermass bodies of a bonded powdered mass which will disintegrate rapidly when exiting from the barrel.

According to one preferred embodiment of the invention, the countermass bodies are composed of a relatively weakly bonded powdered mass. Such bodies have been found to provide advantageous properties, both with regard to the pressure-regulating function of the body during its residence time in the barrel and also with regard to rapid and complete disintegration of the body upon its exit from the barrel. In this case, the material comprises a powdered ballast material of given grain-size distribution and particle form, and a binder. The countermass body may comprise a mixture of different types of powder.

The grain-size distribution, the grain form and the binder content are chosen so that the ultimate countermass body will have a porosity of 30–70%. A porosity of 45–55% is particularly preferred when a small risk zone behind the weapon is desired.

The porous structure has been found to cause those countermass parts which leave the barrel without having been earlier dispersed in the propellant gases to fragmentize very quickly and completely upon exiting from the barrel, and are therewith to slow down quickly in the ambient air. One contributory reason is that the porous structure of the bodies is pressurized by the gas pressure prevailing in the barrel. The fine-grain powder/gas cloud formed by these bodies behind the barrel also has an effective damping effect on the shockwave travelling from the rear end of the barrel.

The ballast material may, for instance, be silicate mineral, metal powder, gypsum, barium sulphate and heavy materials containing tungsten, copper, iron, etc. The grain size should be smaller than 2 mm in diameter, so that the powder will be retarded rapidly in the ambient air when exiting from the barrel, and greater than 0.05 mm, in order for the material to disintegrate.

The proportion of binder used is preferably from 1–10% be weight, calculated on the ballast material, and may consist of sugar, thermosetting resin, glue, Portland cement or gypsum, for instance. Particularly good results have been obtained with a phenol resin binder, in which case the binder content was about 5% of the weight of the ballast material.

The countermass bodies can be produced by first mixing the powder with the binder and then compressing or moulding the powder/binder mixture in a mould.

FIG. 4*a* illustrates an embodiment of one such mould 16 intended for producing a countermass body. Several such countermass elements in which the throughflow passage has mutually different forms and which also consists of different materials may be included in the construction of the ultimate countermass mounted in the weapon. The mould 16 has an inner diameter which corresponds to the diameter of the barrel of the weapon concerned and a central, conical element 17 which provides a nozzle-like throughflow passage in the bodies. Powder having a given grain-size distribution is mixed with, for instance, powdered phenol resin, and compacted in the mould 16 by shaking the mould, and then heat hardened or cured. The thus produced countermass element can then be divided into a number of countermass bodies 18–21, as shown in FIG. 4*b*. Each of these countermass bodies is then turned, so as to obtain the configuration shown in FIG. 4*c*. In this way, each countermass body will obtain an expanding nozzle-like throughflow passage whose inlet orifice decreases in area from body to body rearwardly in the countermass.

The manner in which the countermass functions will now be described in more detail with reference to FIGS. 5*a–c*, which illustrate the behaviour of the countermass at different time points during a weapon firing sequence. The Figures illustrate a countermass of the same construction as that illustrated in FIG. 1, and the same reference signs have been used.

During the initial stage of a firing sequence (not shown), the igniting charge 4 ignites the propellant charge 3 and the gas pressure increases to a value at which the sealing plate 7 located in front of the countermass disintegrates, and thereafter also the sealing plate or the like located behind the countermass. When the countermass consists of weakly bonded powder mass, the combustion gases will fill the cavities or pores in the countermass and therewith assume the pressure prevailing in the barrel.

FIG. 5*a* illustrates the conditions that prevail when the propellant charge is fully ignited. The pressure in the barrel has begun to accelerate the projectile 2 and the countermass body 5. At the same time, generated propellant gases exit through the throughflow passage 6, resulting in a reduction in the pressure maximum in the combustion chamber. Small parts of the countermass material are constantly dispersed in the exiting gas and are accelerated to high velocities.

In FIG. 5*b*, the combustion gases have continued to accelerate the projectile and the countermass body 5. During this acceleration, the body 5 is compressed and countermass material is delivered to the throughflow passage 6, thereby increasing the extent to which the gas throughflow is throttled in said passage.

FIG. 5*c* illustrates how the undispersed part of the countermass body leaves the barrel and the manner in which the gas pressure prevailing in the throughflow passage 6 and in the cavities of said body contribute to rapid disintegration of the body.

The deformability of the countermass body, in combination with the configuration of the gas throughflow passage, enables a relatively high gas pressure to be maintained in the barrel over a longer time period than when using a conventional countermass. The countermass can be said to function as an overpressure valve which functions to reduce the brief maximum pressure and to extend the duration of pressure in the barrel. This enables the capacity of the weapon to be increased without needing to dimension the barrel more powerfully.

Because the gas flow through the rear end of the weapon is extended in time, the effect of pressure on the surroundings and on the operating personnel is also reduced.

When the countermass body is divided into a number of smaller bodies, these bodies can be caused to accelerate consecutively in the barrel, beginning from the rear. By giving the throughflow passage an expanding nozzle form, optionally combined with decreasing inlet area from body to body rearwardly in the countermass, the highest pressure drop and the greatest acceleration is obtained on that countermass body which is located furthest to the rear in the barrel at each moment in time. This consecutive acceleration sequence further improves the ability of the countermass to reduce the brief maximum pressure while, at the same time, maintaining a relatively high gas pressure over a longer period of time than when using a conventional countermass.

I claim:

1. A countermass for a recoilless weapon of the kind having a projectile and a projectile propelling charge in a barrel which is open at both ends, the countermass for placement behind the projectile propelling charge and which is also intended to depart with the propellant gases which exit rearwardly from the weapon when the projectile is propelled forward, the countermass comprising a countermass body means comprised of a weakly bonded powder mass and having at least one gas throughflow passage, the countermass body means having the form of a rearwardly widening nozzle.

2. A countermass according to claim 1 wherein the countermass body means has a porosity of 30–70%, preferably 45–55%.

3. A countermass according to claim 1, wherein the throughflow passage is an axially extending passage located centrally in the countermass body means.

4. A countermass according to claim 1, wherein the throughflow passage is initially blocked at the rear end of the counter mass and is to be blown clear during an initial stage of a firing sequence.

5. A countermass according to claim 1, wherein said countermass body means comprises a plurality of mutually sequential and mutually separate countermass bodies.

* * * * *